US011534933B2

(12) United States Patent
Saccone, Jr.

(10) Patent No.: US 11,534,933 B2
(45) Date of Patent: Dec. 27, 2022

(54) FOOD INGREDIENT SLICING APPARATUS

(71) Applicant: Kevin James Saccone, Jr., Norwood, MA (US)

(72) Inventor: Kevin James Saccone, Jr., Norwood, MA (US)

(73) Assignee: Kevin J. Saccone, Jr., Medfield, MA (US)

( * ) Notice: Subject to any disclaimer, the term of this patent is extended or adjusted under 35 U.S.C. 154(b) by 40 days.

(21) Appl. No.: 16/673,033

(22) Filed: Nov. 4, 2019

(65) Prior Publication Data

US 2021/0129366 A1 May 6, 2021

(51) Int. Cl.
*B26D 7/06* (2006.01)
*B26D 1/03* (2006.01)

(52) U.S. Cl.
CPC ..... *B26D 1/03* (2013.01); *B26D 7/06* (2013.01); *B26D 2210/02* (2013.01)

(58) Field of Classification Search
CPC .... A22C 17/033; A22C 17/0033; B26D 7/06; B26D 7/0608; B26D 7/0641; B26D 2210/02
See application file for complete search history.

(56) References Cited

U.S. PATENT DOCUMENTS 1,351,903 A * 9/1920 Hara ..... A23G 9/283 83/267
3,530,915 A * 9/1970 Moriuchi et al. .... B26D 7/0641 83/92
4,050,339 A * 9/1977 Soleri ..... B26D 1/46 83/411.2
4,202,260 A * 5/1980 Weger ..... A21C 15/002 401/5
9,123,196 B1 * 9/2015 Salem ..... A21C 15/00
2002/0176920 A1 * 11/2002 Babacan ..... A47J 37/049 426/523
2011/0209661 A1 * 9/2011 Fritz-Jung et al. ..... B25J 11/00 118/712
2011/0226101 A1 * 9/2011 Volkl ..... B26D 1/28 83/176
2012/0185086 A1 * 7/2012 Khatchadourian et al. ..... G07F 11/70 99/345
2014/0087048 A1 * 3/2014 Webster et al. ..... A21C 9/04 83/76.1

FOREIGN PATENT DOCUMENTS

DE 10 2010 035 656 A1 * 2/2012 ..... B26D 7/0641
DE 2010 016 156 U1 * 2/2012 ..... B26D 7/0641
EP 0 096 423 A2 * 12/1983 ..... B26D 7/0641
EP 2 227 964 A2 * 9/2010 ..... B26D 2210/02
EP 2 532 493 A1 * 12/2012 ..... B26D 7/0641
WO WO 2008/020105 A1 * 2/2008 ..... B26D 7/0641

* cited by examiner

*Primary Examiner* — Boyer D Ashley

(57) ABSTRACT

The present invention relates to the field of automated food preparation. Specifically, the present is a invention system and method for depositing slices of an ingredient onto a bread or other media. Additionally, the present invention can be used to selectively slice a plurality of ingredients onto a sandwich based on customer inputs and the apparatus can be used for slicing meats, cheeses, vegetables and other deli products.

3 Claims, 9 Drawing Sheets

OPEN

CLOSED

FOOD INGREDIENT SLICING APPARATUS

REFERENCE TO PRIOR FILING

The present application claims priority to the previously filed provisional application No. 62/770,773, filed on Nov. 22, 2018 and hereby incorporates the subject matter of the provisional application in its entirety.

BACKGROUND OF THE INVENTION

Field of the Invention

The present invention relates generally to food preparation. More particularly the present invention relates to a system and method that may automatically make a plurality of different food items with different ingredients wherein the ingredients are deposited by a machine (the apparatus) which is governed by a computer. The apparatus outlined herein is most useful in regard to the making of fast food items such as sandwiches, salads, pizzas and etc. or in simply slicing ingredients such as cold-cuts to order as is done in supermarkets across the United States.

BACKGROUND

The typical food production process involves human labor "prepping" the ingredients each day by means of slicing, chopping, portioning and etc. a multitude of ingredients based on an estimate of daily demand; and then storing the prepared ingredients in a refrigerated preparation table; then when a customer orders a certain menu item an employee generally removes the prepared ingredients from the preparation table and then assembles the order by hand. To clarify for those unfamiliar with the standard practices in the food industry; suppose a restaurant sells sandwiches and salads, the workers will generally prep the ingredients such as cold-cuts, vegetables, condiments and etc. and ensure that a sufficient quantity of each is ready to meet customer demands in a timely manner and load the ingredients in a prep table which holds the ingredients at a height that is convenient for the workers to access and visualize at a given moment.

Then, as each order comes in, a worker must read a ticket or display and then take pre-prepared foods from the prep table and assemble the order by hand matching the customer's order on the ticket or display. For instance, if someone orders a ham and cheese with lettuce tomato and mayo, the worker will get a printed ticket outlining the requested order, they must then read the ticket, then scan the prep table to locate the lettuce, tomato, ham and cheese and then place each ingredient onto the sandwich bread in a process that has a great deal of wasted motion and also a high potential for inaccurate order fulfillment and portion controls.

Therefore, what is presented herein is a food preparation system which eliminates the wasted motions involved in the process of preparing and storing ingredients in a refrigerated prep table, and then slowly and inaccurately assembling the ingredients by hand per each order, and also eliminates the waste and defect opportunities involved in printing receipts to be read by workers. Instead, the present invention will host all the ingredients of a specified menu within an apparatus or group of apparatuses that are contained within a refrigerated unit or room, and slice each ingredient as it is needed with the agility and ability to selectively deposit and control each ingredient that gets deposited onto the bread or another medium in order to complete a sandwich or other food item that is made to order and do so in a fast and automated fashion wherein the apparatus can communicate directly with a point of sale system, customer kiosk, mobile device or etc. reducing the amount of defect opportunities and "middle men" involved in the production of a food item.

SUMMARY OF THE INVENTION

Be it known that I, Kevin J. Saccone Jr., of Norwood, Mass. have invented certain improvements for depositing ingredients onto a food item, of which the following is a full, clear and exact description which outlines the scope and nature of the present invention.

The primary aspect of the food preparation system outlined herein is a slicing apparatus which slices ingredients as the method of depositing them onto a piece of bread or other medium. The actual blade of the slicing apparatus operates in a similar fashion to a regular rotary slicer. However, rather than having items placed on a carriage to be sliced one at a time, the present invention houses multiple ingredients simultaneously in separate chambers within a chassis of the apparatus and passes the separate chambers over the blade by means of rotation or reciprocation of the chassis while maintaining control over which ingredients are to be sliced. This apparatus has the capability of taking computer inputs and directing the apparatus to slice particular ingredients without any changeover time to load and unload different ingredients. The slicing apparatus can slice directly onto a sandwich, deli bag, or other medium traveling beneath the apparatus on a conveyor.

In use, the apparatus may revolve food items over a spinning slicer blade and electronic controls may govern which food items within the chambers should be directed towards the blade to be sliced. Both the chassis which moves the ingredients and the slicer blade may be powered by an electronic motor and it need not be the same motor powering each component. The primary function of the slicing apparatus will be to take solid (unsliced) foods that get loaded into the chambers of the apparatus and slice them onto a sandwich or other food item based off of a customer's order. The apparatus may also be capable of further slicing some prepared foods, for instance slivered onions could be sliced into smaller pieces.

The present invention enables one to create an automated food preparation system. The food preparation system outlined in this invention uses a computerized system including: a computer memory, processor, inputs and outputs, a display, sensors and all hardware and software components necessary to run a state-of-the-art industrial machine and to integrate the present invention with other computerized devices, and to send commands to control and operate machinery designed to deposit ingredients. These ingredients may be deposited onto a form of bread, dough, a salad bowl, or straight into a package or bag. For example, as the bread moves along a conveyor, the apparatus would deposit ingredients onto the bread from above, by means of slicing a pre-determined portion of each ingredient onto the bread as it passed below the apparatus on a moving conveyor, and it would receive the instructions/inputs on which particular ingredients to deposit from a customer or food service worker or automated process.

The present invention is designed to build sandwiches and similar food items to order based on a customer's requests. The present invention is unique in the sense that it can quickly and efficiently create food items via machinery while remaining agile enough to tailor each order according to the customer's requests. This is greatly different from some factory style, low variety, high production, sandwich assembly lines where the food items are produced in bulk and without variation and they are generally distributed as pre-made sandwiches; and switching from producing one food item to another often has notable changeover and production costs.

With the present invention, the apparatus and machinery is so agile that it can be utilized in the retail environment and make food items to order as part of a just-in-time production system which fulfills an order rapidly based on a customer's specific requests. This can be accomplished in several ways. One of which involves the customer placing their order at the point of sale by means of either operating a self-serve kiosk, ordering on their mobile device or computer, or verbally instructing a food service worker who is operating a computerized device integrated with the slicing apparatus, the apparatus can then gather all the inputs necessary to complete one sandwich or other food item, and then command the slicing apparatus(es) to build the sandwich as instructed by the customer.

In another configuration, the computerized system may receive inputs throughout the process of forming the food item. For example, inputs may be provided incrementally as customers move alongside their food item in a waiting line that runs parallel to the assembly line and choose which ingredients they want dispersed onto their food item as they watch it being made. This embodiment may require an integrated touch screen or substitutable input device that gives customers or employees the ability to choose which ingredients to dispense onto their food item from the machinery.

The input device can show the available options at each station and give customers the ability to choose which ingredients they want on their food item. The input may then be received by the computerized system, and generate a command sent to the equipment to instruct it to disperse the selected ingredients onto their food item. For instance suppose a menu required a total of three slicing apparatuses to be used, one for produce, one for meats and one for cheese in that respective order the customer could start at the slicing apparatus for produce, look at the list of options and then select which options they want on their sandwich, shortly after the selection is made the slicing apparatus would deposit the selected ingredients onto their bread, then the bread would move down a conveyor belt so that it is positioned under the meat slicing apparatus wherein they would again select which meats to deposit onto their sandwich and the process would continue as the customer follows their food item along and presumably watches their food item being made via a glass safety window and provides inputs by means of a touch screen or similar device on their side of the safety glass. Although such customer participation will not be necessary in all applications of the invention, it may provide an interactive experience for customers which may be valuable to distract and engage customers while they are waiting for their food.

Such a flexible, yet mechanized, manufacturing solution is currently not found in the food service industry where businesses typically rely on agile and adaptable human labor to deal with a high volume of special requests, variations and substitutions in orders. The present invention will help restaurants and food service businesses increase the productivity of human labor, and decrease the costs associated with human error such as inaccurate order fulfillment and portion controls by assembling food products such as sandwiches, wraps, burritos, and salads primarily by machine.

Such savings for restaurants will also be advantageous to the consumers and employees as restaurants can offer more competitive pricing and higher quality ingredients meanwhile enabling higher wages to be paid as the machinery increases the production capacity and earning potential of employees working in food service establishments. It is important to note that the final configuration of each slicing apparatus will be dependent upon the menu or application it is being used for but the principles of operation will remain the same and are outlined herein.

The following drawings will demonstrate how the slicing apparatus operates and the novel characteristics of the method and apparatus.

DETAILED DESCRIPTION

Figure 1:
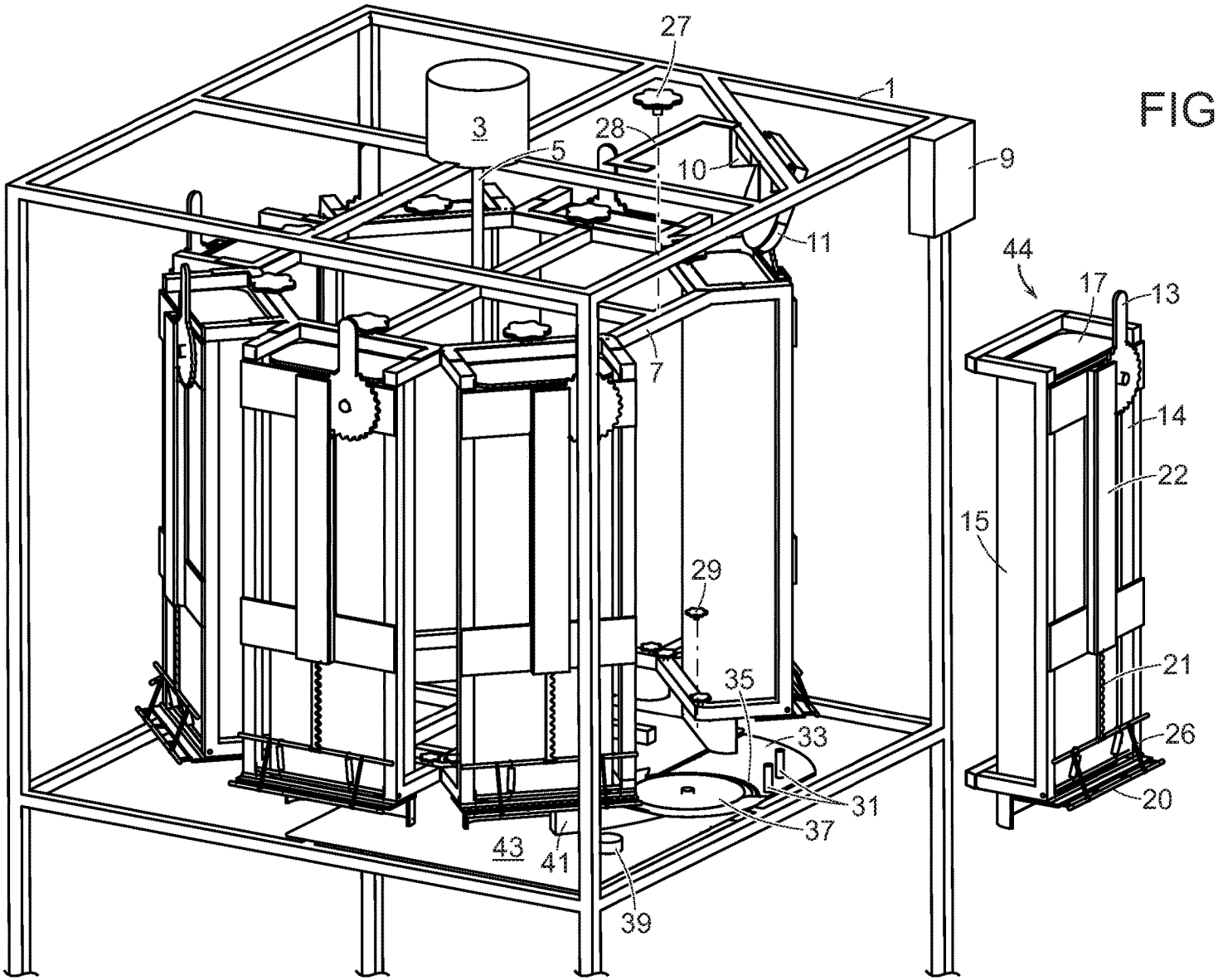
FIG. 1 shows a perspective view of the slicing apparatus, wherein the motion of the chassis is paused and one ingredient chamber is removed from the chassis.

To enable others skilled in the art to understand my invention, I will describe the manner in which I have carried it out. FIG. 1 is a perspective view of the slicing apparatus. A frame [1] serves to hold the main components in place over a production area such as an assembly line, the frame [1] provides support for: the mounting of a motor [3], the rotation and vertical position of a driveshaft [5], the mounting of an engagement bumper [11], a rotatable chassis [7] which is secured to the driveshaft [5], a computer [9] used to control the apparatus, a blade [35], a blade cover [37], a frame cover or guard [43], as well as indirect support for a plurality of other parts.

As shown, the rotatable chassis [7] is configured to house a total of eight ingredient chambers [44] forming a rotatable chassis assembly, with one ingredient chamber removed from the chassis [7] by means of removing an ingredient chamber top knob [27] and an ingredient chamber bottom knob [29] which serve to securely mount the ingredient chamber to the chassis [7]. The ingredient chambers are designed to securely connect to the chassis [7] and be removable in a manner that is efficient for purposes of restocking the slicing apparatus with minimal downtime. The ingredient chambers are comprised of: an ingredient chamber frame [14] and an ingredient tube [15] which is a metal, polymer or other food grade tube which makes contact with a food ingredient on its inner wall, and gets secured to the ingredient chamber frame [14].

The ingredient tube has a lid [17] which serves to close the top of the ingredient tube [15] and also provide a backstop for an ingredient tube spring [16] which is not visible in some figures as it is inside the tube. The ingredient tube spring [16] makes contact with a food-grade ingredient tube buffer [18] which contacts the food and provides downward pressure to the ingredient. The ingredient chambers [44] are designed with a gear lever [13] which can rotate on axis and is geared to a gear rack [21] with teeth of the same size and pitch which is linked to an ingredient flap or obstructing device [20] that is secured to the bottom of the ingredient chamber frame [14] by means of flap hinges [24] that have one end secured to the ingredient chamber frame [14] and the other end secured to the ingredient flap [20] which allows limited rotation of the ingredient flap [20]. The gear rack [21] is kept in alignment by a gear rack guide [22] which restricts the gear rack [21] from coming out of alignment by securing the gear rack with gears on a stud or shaft having teeth of the same pitch and size making contact with the toothed side of the gear rack [21] to allow upwards and downwards movement while eliminating lateral shifting of the gear rack [21] and by keeping the flat sides of the gear rack [21] held flush against a low friction food grade material such as sheet metal, UHWM polyurethane or etc.

As the gear lever [13] rotates clockwise, it moves the gear rack [21] vertically upwards, and as the gear rack [21] moves upwards so does linkage [26] which is secured on one end to a horizontal rod at the bottom of the gear rack [21] and to an end of the ingredient flap [20] on the other end; as the gear rack [21] moves up, the linkage [26] pulls the ingredient flap [20] causing it to rotate counter-clockwise, moving the ingredient flap [20] so that it no longer obstructs the downward flow of ingredient from within the ingredient tube [15]. There are also extension springs [23] which are connected to the horizontal rod on the bottom of the gear rack [21] on one end and fixed to the bottom of the ingredient chamber frame [14] on another end. The extension springs [23] serve to apply downward pressure on the gear rack [21] at all times, this downward pressure causes the linkage [26] to apply a downward pushing force into the end of the ingredient flap [20] forcing it to rotate clockwise into the closed position, and when ingredient flap [20] is closed/perpendicular to the gear rack [21] it may make contact with the bottom of the ingredient chamber frame [14] itself or a simple stopper so that the ingredient flap [20] does not rotate beyond parallel to the floor when in the "closed" position.

Likewise, since the gear lever [13] is geared to the gear rack [21] the downward force of the extension springs [23] serve to keep the protruding handle of the gear lever [13] in the vertical position at rest. The force of the extension springs [23] must exceed the force of the ingredient tube spring [16] and the weight of the ingredient itself in order to keep the ingredient flap [20] closed and to prevent the ingredient from falling out when the ingredient tube [15] is loaded with ingredient. The gear lever [13] has been designed with an elongated lever protruding from the gear for the purpose of increasing the rotational leverage that can be had by acting upon the handle or lever of the gear rack [13], therefore making it easier to turn the gear lever [13] to overcome the force of the extension springs [23] and open the ingredient flap [20] when gear lever [13] is moved in a clockwise rotation.

While the ingredient tube [15] and the ingredient tube frame [14] are depicted as two separate parts herein that join together, it is also entirely feasible and within the scope of the present invention to merge the two components into a single ingredient tube that could possess all of the features of the combined parts and be mountable directly to the chassis [7].

Whether, the ingredient residing within a particular ingredient tube [15] is to be sliced or not is dependent upon whether the gear lever [13] of that tube is rotated in a clockwise fashion; hence all of the ingredients are housed within the apparatus and held in place entirely by the mechanical forces supplied by contact, leverage, springs and etc. and the slicing apparatus governs which ingredients are to be sliced and which are not to be sliced by means of controlling the position of engagement bumper [11].

Engagement bumper [11] is held in place above the chassis [7] by means of the engagement bumper bracket and hinge [10] which connects to the frame [1] on one end and the other end serves as a hinge to allow rotation of the engagement bumper [11]. The rotational position of the engagement bumper [11] is shown being controlled by a solenoid [12]. Note that a plurality of actuator styles are feasible and within the scope of the present invention for instance the solenoid [12] could be replaced with: an electronic actuator or motor, a pneumatic air cylinder, a hydraulic cylinder or etc. Solenoid [12] is depicted as having a spring built into the solenoid [12] to either push or pull the solenoid piston while it is at rest, and when properly charged with electricity the solenoid will overcome the force of the built-in spring and move the position of the solenoid [12]. Therefore, only a periodic charge is needed to move the solenoid [12].

Figure 5:
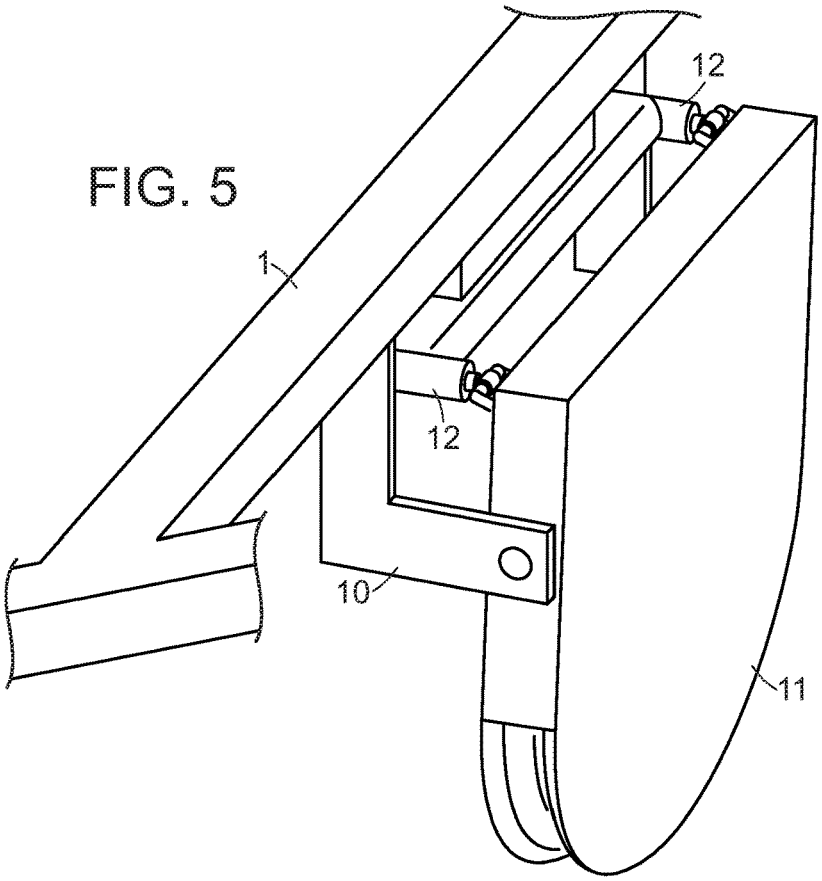
FIG. 5 is a perspective view of the engagement bumper in a slicing position.

Note that the engagement bumper [11] when in the "slicing" position, further depicted in FIG. 5, meaning that the engagement bumper [11] is perpendicular to the floor, places the engagement bumper [11] in the same path of travel as the gear lever [13] as the chassis [7] rotates clockwise. Therefore, when the engagement bumper [11] is in the "slicing" position it will make contact with gear lever [13] manipulating gear lever [13] to rotate clockwise, which will consequently raise the gear rack [21] and open the ingredient flap [20] allowing the ingredient to flow downwards.

Shortly after engagement bumper [11] makes contact with the gear lever [13] and opens the ingredient flap [20], as the chassis [7] continues its rotation the inner side of the ingredient flap [20] is intercepted by flap opening bumper(s) [31] which serve to push the ingredient flap into the "locked open" position, and preventing the ingredient flap [20] from closing due to the force of the extension springs [23] while the slice is being performed and immediately afterwards. The flap opening bumpers [31] are spaced along the path of rotation so that the timing will align perfectly with the movement of the gear lever [13] acting upon the ingredient flap [20] and the ingredient flap [20] will be open far enough to make contact with the flap opening bumpers [31]. Also note, that while flap opening bumpers [31] are depicted in a position to make direct contact with the flap [20] it is also entirely feasible and within the scope of the invention to use a different style action that could be mounted to the frame [1] and indirectly hold the flap [20] by manipulating the gear lever [13] after it has moved past the engagement bumper [11] to hold the flap [20] open during the slicing process.

Once the ingredient flap [20] begins to open, the ingredient residing in the ingredient tube [15] will travel downwards and make contact with a height adjustable platform [33] which is positioned slightly below the blade [35] so that as the ingredient comes into contact with the blade[35] a slice will be generated and will drop below the apparatus onto or into a desired medium such as sandwich bread, a bag, or etc. As the chassis [7] continues its clockwise rotation due to the torque and force supplied by the motor [3] it carries the ingredient onto a blade cover [37] which is a low-friction cover for the blade intended to reduce friction between the blade [35] and the ingredient and to make cleaning the apparatus easier. The blade [35] as depicted is a rotary blade wherein the cutting edge is the outer circumference of the blade [35], therefore the middle of the blade [35] serves no real purpose other than to rotate the outer edge of the blade [35] and if left uncovered the rotating middle surface of the blade [35] would create unnecessary friction between the ingredient and the middle of the blade [35].

As the chassis [7] continues its rotation, due to the momentum of the chassis [7] and the force and torque supplied by the motor [3], an ingredient follows the path of rotation, guided by contact with the ingredient tube [15] and the ingredient flap [20], the ingredient then comes into contact with the ingredient ramp [41] which is secured to the frame cover [43].

Let it be understood that so long as the motor [3] is strong enough, and the apparatus is designed and operated correctly the contact between the engagement bumper [11] and the gear rack [13] should not slow down the rotation of the chassis [7] to a considerable degree as the weight of the chassis [7] loaded with ingredient and steady force from the motor [3] will generate a great deal of momentum. Nor will the contact between an ingredient and the ingredient ramp [41] slow down the rotation of the chassis [7] a considerable degree.

The purpose of the ingredient ramp [41] is to raise the vertical position of the ingredient prior to the ingredient flap [20] being closed; assisting the process of getting the previously sliced ingredient back up the ingredient tube [15] so that it is contained within the slicing apparatus and will not be sliced again until the engagement bumper [11] contacts the gear lever [13] of the respective ingredient chamber again. The ingredient ramp [41] lifts the ingredient up and away from the frame guard [43] so that the bottom of the ingredient is above the ingredient flap [20] when it begins to close, eliminating the possibility of ingredient being jammed by the ingredient flap [20] in the ingredient tube [15]. Recall that the ingredient flap [20] is still in the "locked open" position, and with the design outlined herein it will remain so until the ingredient flap [20] makes contact with a flap closing bumper [39] which serves to initiate the closing of the ingredient flap [20] by making direct contact, and the extension springs [23] finalize the closing of the ingredient flap [20].

In summary, this sequence of events happens every time an ingredient is designated for slicing, and it all happens while the chassis[7] is in a state of rotation: engagement bumper [11] gets moved into the "slicing position" and makes contact with gear lever[13], causing ingredient flap [20] to open, ingredient flap is held open via flap opening bumper(s) [31], ingredient moves downwards and a single slice is separated by the blade [35], ingredient travels upward via ingredient ramp [41], ingredient flap [20] makes contact with flap closing bumper [39], flap is closed with ingredient inside it.

The present invention outlined herein operates by depositing one slice of a particular ingredient at a time, each time an ingredient is to be sliced the engagement bumper [11] is to be moved into the slicing position so that it will make contact with gear lever [13] which will open the ingredient flap [20]; although the slicing apparatus works by generating one slice at a time the slices can be produced in such rapid succession that it appears to be nearly a continuous process to the naked eye.

Let it also be understood that the present invention is designed to work while the chassis [7] is in a state of rotation and the ingredient chambers are revolving about the axis of the driveshaft [5] at a rate of approximately 60 revolutions per minute, with faster and slower speeds entirely within the scope of the present invention and necessary for certain menus and applications. Since the chassis [7] is rotating quickly the same ingredient can make multiple passes over the blade [35] in a short period of time and it can also pass different ingredients over the blade without any changeover time or adjustment of the chassis required, the only thing required for each slice is that the engagement bumper [11] is in the "slicing" position which will be more clearly explained in FIG. 5. Therefore, the present application can deposit a plurality of slices, in any conceivable sequence or combination very quickly and efficiently.

Let it also be understood that there must be some means of communicating the rotational position of the driveshaft [5] to the computer [9] by means of sensors and or encoders; the present invention utilizes a motor [3] with a built in encoder and a safety brake, the encoder communicates the rotational position of the driveshaft [5], the driveshaft [5] is to be keyed and secured to the chassis [7] therefore the rotational position of the chassis can be accurately inferred by reading the rotational position of the driveshaft [5]. Likewise, the computer[9] must have the means to be programmed so that it knows the location of each ingredient chamber, more importantly the location of the gear lever [13] and where they reside along the possible 360 degrees of driveshaft [5] rotation, and utilize algorithms and applications that can calculate the appropriate time to charge the solenoid [12], thereby moving the engagement bumper [11] in order to slice a particular ingredient; and the computer [9] is to have a programmable memory for the operator to adjust portions, and the computer [9] will also have the capability of translating inputs into commands that involve multiple outputs.

For example, if a customer selects that they want turkey on their sandwich the computer [9] is programmed to direct the machinery to deposit six slices of turkey as the standard portion, or if a customer selects turkey and ham for their sandwich, the computer [9] could direct the slicing apparatus to slice three slices of turkey and three slices of ham for the same standard portion of six slices of meat.

Using the number of slices will serve to be an accurate means of controlling portions as a predetermined thickness and uniform pressure and process will minimize variation in the weight of the slices. The computer [9] will also be capable of being integrated with a plurality of other machinery such as traditional food depositors, conveying systems, and etc. so that a restaurant or eatery can program a complete system to fulfill menu orders.

Also, the computer [9] is to be integrated with a plurality of sensors which are not depicted in the drawings as they are not essential to understanding the invention, for instance, a sensor could be used to ensure that the slicing apparatus does not deposit slices until a slice of bread is underneath the apparatus on a conveyor, to notify an operator that a particular ingredient is running low, for a plurality of safety reasons and etc.

Figure 2:
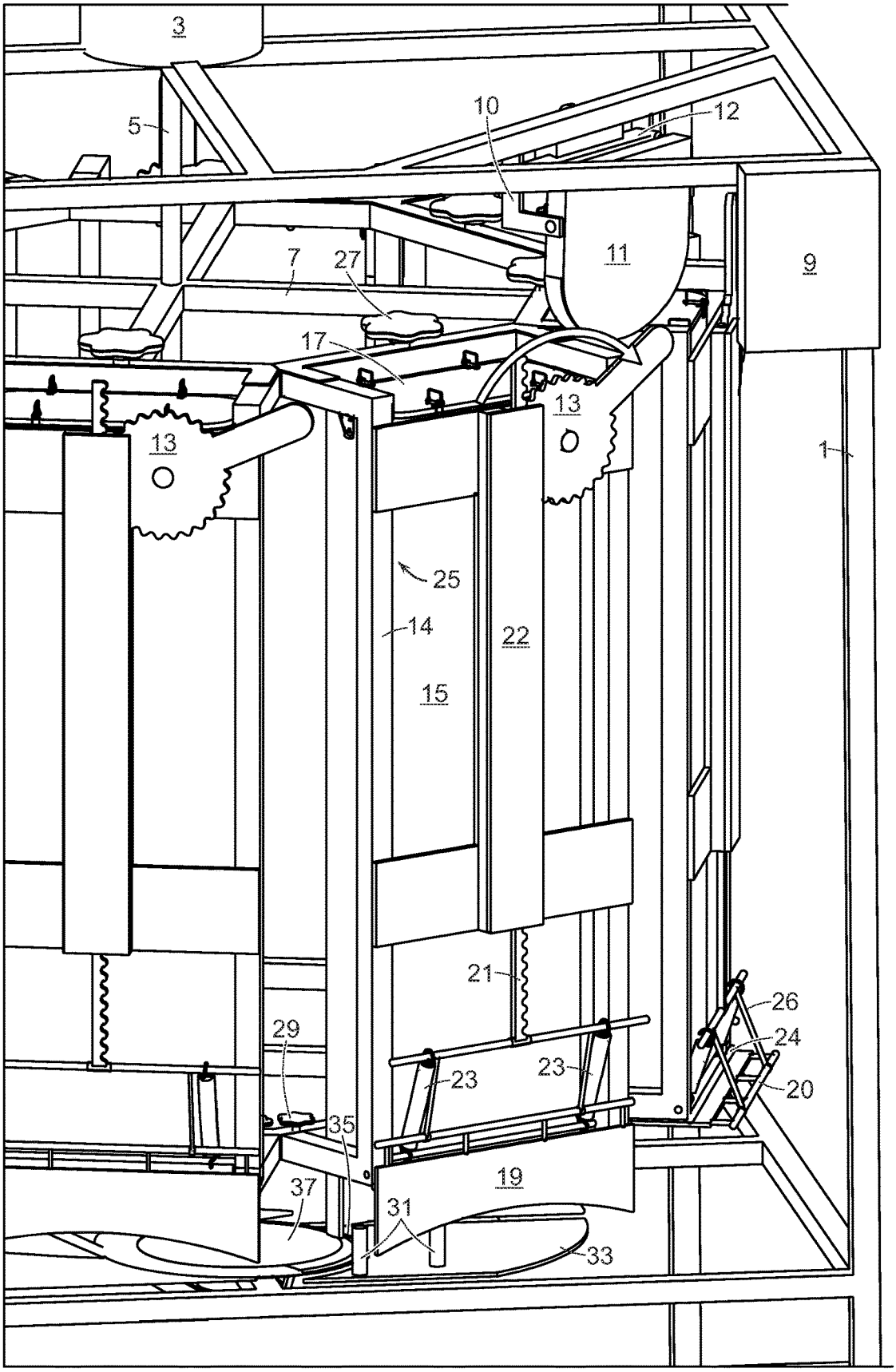
FIG. 2 is a perspective view of the slicing apparatus which depicts how the interaction of the engagement bumper and the gear lever are used to open the ingredient flap as the chassis rotates in a clockwise manner.

FIG. 2 is a perspective view which depicts the interaction of the engagement bumper [11] and the gear lever [13]. Notice that the gear lever [13] gets rotated clockwise by means of making contact with the engagement bumper [11] while the chassis [7] is rotated by the motor [3]; therefore, the momentum of the moving chassis serves to assist the force and torque supplied by the motor [3] in moving the gear lever [13] clockwise when it comes into contact with the engagement bumper [11]. Notice that as the gear lever [13] is rotated, the ingredient flap [20] begins to open and when the flap opening bumpers [31] contact the ingredient flap [20] on the inside they push the ingredient flap into a "locked open" position [19].

Figure 3:
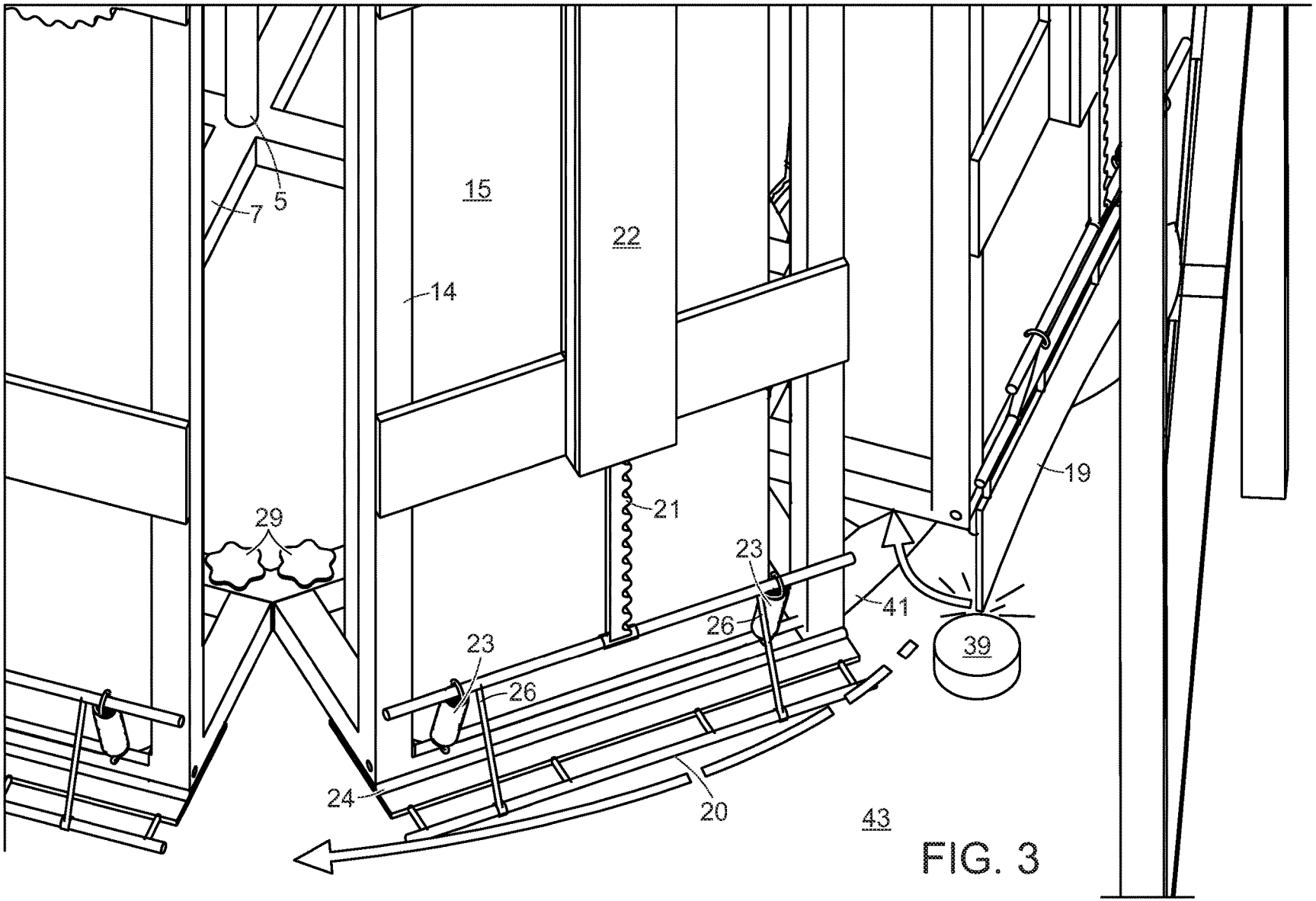
FIG. 3 is a perspective view of the slicing apparatus which depicts how the flap closing bumper closes the ingredient flap as the two make contact as the chassis rotates in a clockwise manner.

FIG. 3 Depicts the how the flap closing bumper [39] makes contact with the locked open ingredient flap [19], initiating the closing of the ingredient flap [20], enabling the extension springs [23] to complete the motion of closing the ingredient flap [20].

Figure 4:
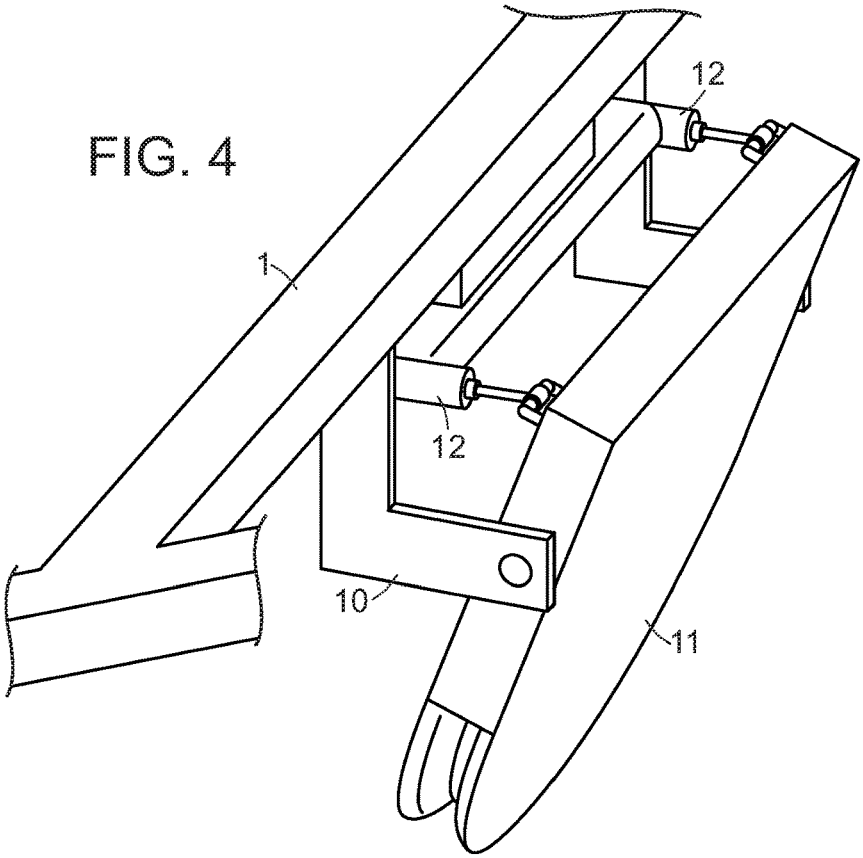
FIG. 4 is a perspective view of the engagement bumper in a non-slicing position.

FIG. 4 is a perspective view of the engagement bumper [11] in the "non-slicing" position. As depicted the solenoids [12] are "pull" solenoids that are spring loaded to naturally exert a small push by means of a spring contained within the solenoid [12], and when the solenoid is charged with electricity a "pull" is generated, retracting the piston/rod of the solenoid [12] and moving the engagement bumper [11]. The engagement bumper bracket and hinge [10] secures the engagement bumper [11] to the frame [1] while also providing an axis for rotation by means of a hinge or pin which runs through the engagement bumper [11]. When the engagement bumper [11] is in the "non-slicing" position let it be understood that the protruding lever of a gear lever [13] will not come into contact with the engagement bumper [11] while the chassis [7] rotates, and the protruding lever of the gear lever [13] will pass by the engagement bumper [11] on the right side (from this view) without making any contact.

FIG. 5 shows the engagement bumper [11] in the "slicing" position, note that the solenoids [12] are contracted presumably by means of an electric charge governed by the computer [9] and also that the engagement bumper [11] has rotated upon the axis of the engagement bumper bracket and hinge [10] so that Its positioning is nearly vertical and it will make contact with any gear lever [13] in its path as the chassis [7] is rotated. Note that the chassis and ingredient chambers are to be built so that all of the gear levers [13] are to be the same distance and height from the center of the chassis [7] therefore the position of the engagement bumper [11] can remain fixed above the chassis, only requiring a small change in the rotational position to determine whether the engagement bumper is in the "slicing" or "non-slicing" position.

It should also be noted that there will be circumstances wherein the engagement bumper [11] will be desired to make contact with multiple gear levers [13] without the need to move from the "slicing position". For example, suppose an Italian cold-cut sandwich was being made which requires salami, capocollo, and mortadella and the three ingredients were in successive order within the chassis; for instance the salami occupied the first $\frac{1}{8}^{th}$ of the chassis [7], or roughly from 0 degrees to 45 degrees of driveshaft[5], the capocollo occupied the second $\frac{1}{8}^{th}$ of the chassis [7], or roughly 45 degrees to 90 degrees of driveshaft[5], and the mortadella occupied the third $\frac{1}{8}^{th}$ of the chassis [7], or roughly 90 degrees to 135 degrees of driveshaft [5], with other ingredients occupying the other $\frac{5}{8}^{th}$'s of the chassis [7] and the clockwise rotation of the driveshaft [5] beginning at 0 and ending at 360 degrees; if the computer [9] is programmed efficiently it can perform a sequential slice of salami, capocollo and mortadella by activating the solenoid [12] to move the engagement bumper [11] into the "slicing position" and hold it there for the duration of time required to make contact with the gear lever [13] of each of the three aforementioned ingredient chambers (salami, capocollo and mortadella) and then to move to the "non-slicing" position after the three gear levers [13] had been engaged by the engagement bumper [11].

While the simplest configuration of the slicing apparatus will function by moving the engagement bumper [11] to the "slicing position" so that it makes contact with a single gear lever [13] and then moving back to the "non-slicing" position for each slice, the previous example is intended to serve as an example of how a single movement of the engagement bumper can be used to slice a plurality of ingredients with more complex programming of the computer [9] that can yield a greater efficiency. Also note that the shape of the engagement bumper [11] can be modified in a number of ways, and the design of this component is not of pivotal importance to understanding the scope and spirit of the invention.

Figure 6:
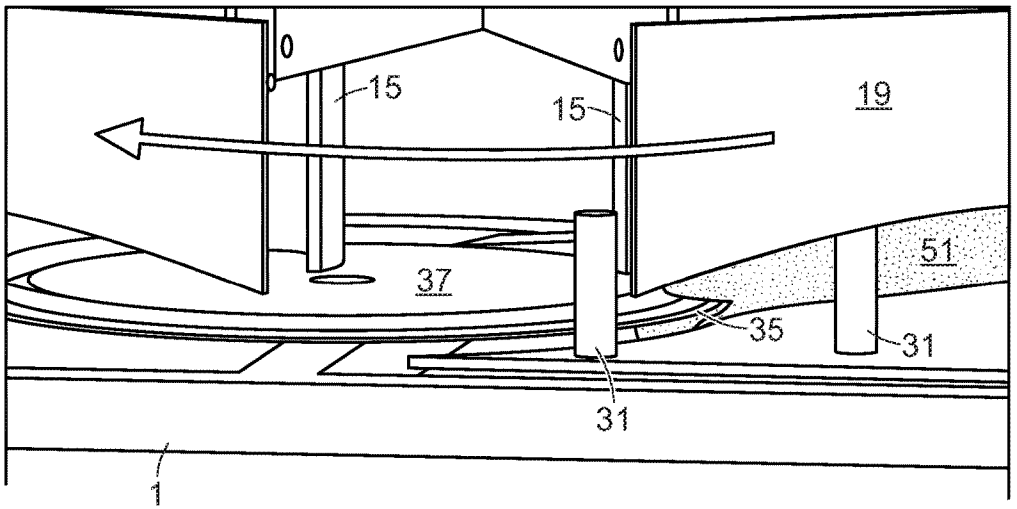
FIG. 6 is a perspective view that shows an ingredient being sliced by the blade while the flap opening bumpers assist the ingredient flap in opening all the way as the chassis rotates in a clockwise manner.

FIG. 6 demonstrates how the flap opening bumpers [31] make contact with the ingredient flap [20] and force the ingredient flap into the "locked open" position [19]. An ingredient [51] is seen mid-slice, the blade [35] slicing a piece off of ingredient [51] that is to be deposited below the slicing apparatus. The flap opening bumpers [31] could also be designed to manipulate the gear lever [13] from above being mounted to the frame [1] in a different configuration which serves the same purpose of holding the flap [20] open as the ingredient [51] gets sliced by the blade [35].

Figure 7:
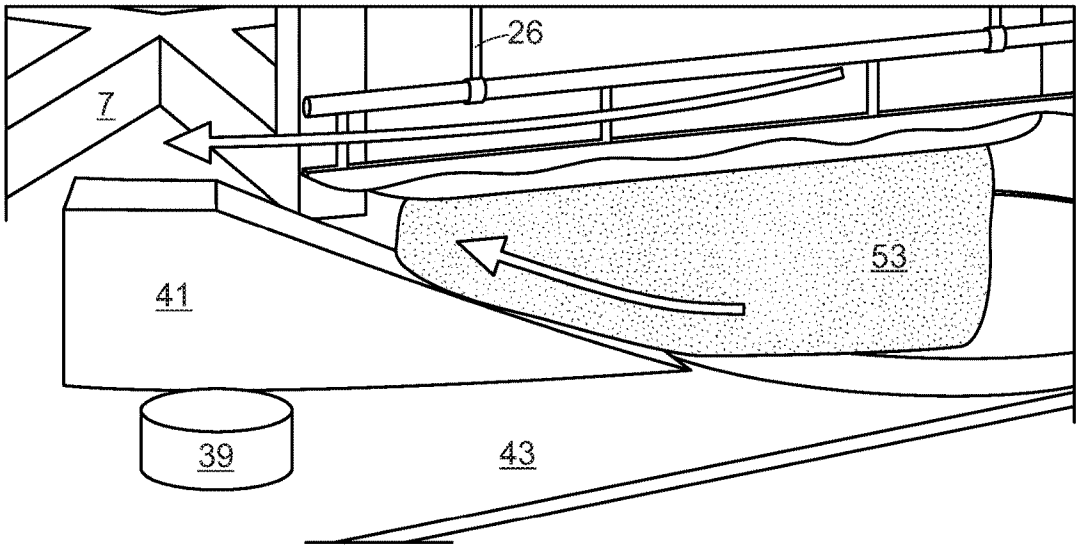
FIG. 7 is a perspective view that shows an ingredient traveling up the ingredient ramp, and the fixed proximity of the ingredient ramp and the flap closing bumper, as the chassis rotates in a clockwise manner.

FIG. 7 demonstrates an ingredient [53] traveling up the ingredient ramp [41]. Note that a section of the ingredient flap in the "locked open" position [19] has been made transparent to give a better visual of the ingredient [53] traveling up the ingredient ramp [41]. Also note that the flap closing bumper [39] is positioned in proximity to the ingredient ramp [41] so that the ingredient flap in the "locked open" position [19] will be closed while the ingredient [53] is elevated by the ingredient ramp [41]. The flap closing bumper[39] could be as simple as a metal or polymer track roller that gets bolted to the frame guard [43], ideally one that is padded by urethane or a similar material that will resist wear and tear while reducing the noise and impact of the ingredient flap in the "locked open" position [19] coming into contact with the flap closing bumper [39] on a repeated basis. In more complex embodiments the flap closing bumper [39] could be motorized or geared to a motor so that it rotates in a counter-clockwise fashion, and it could likewise have teeth similar to a gear that could help it to function more smoothly.

Figure 8:
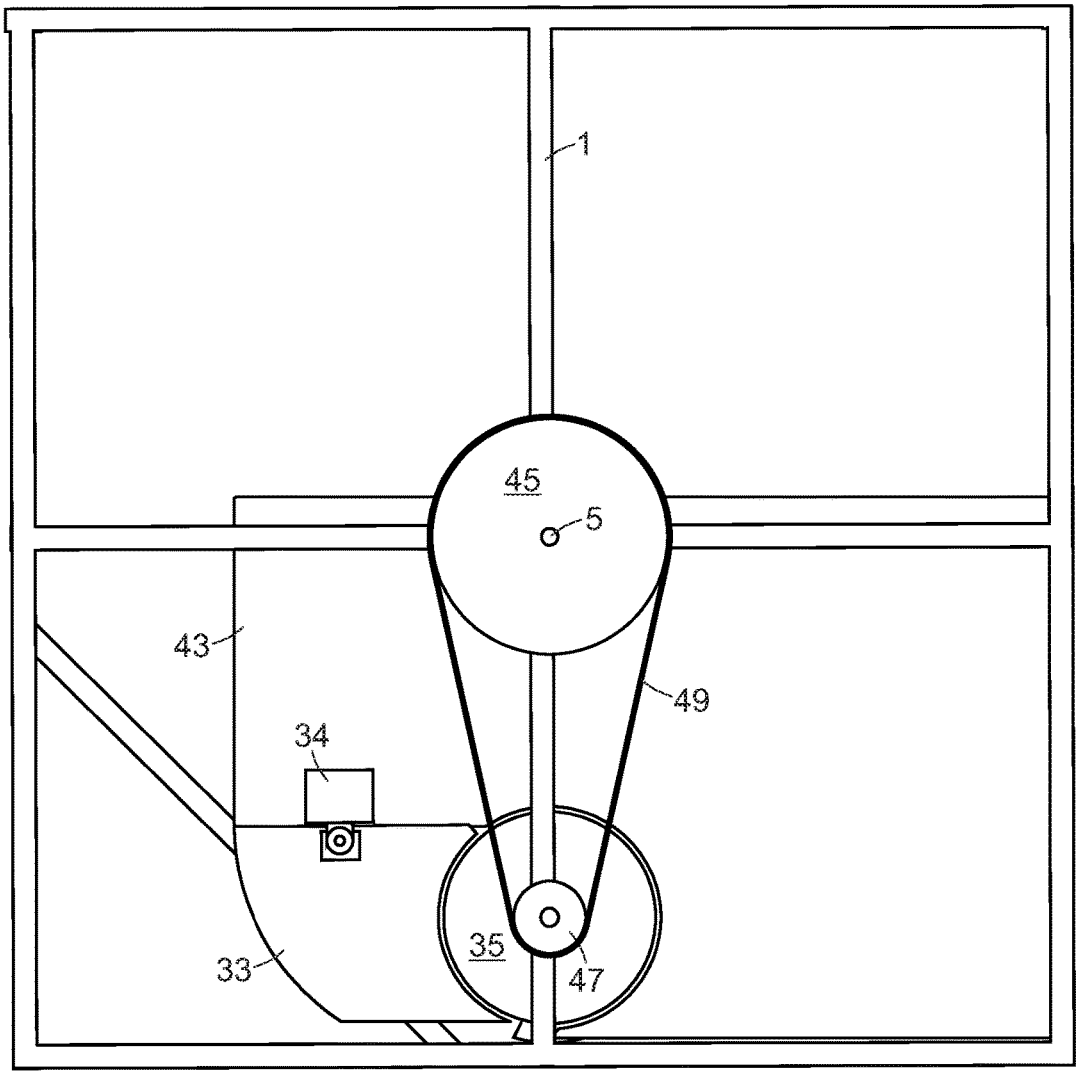
FIG. 8 shows a bottom view of the slicing apparatus which demonstrates how the rotation of the driveshaft is utilized to rotate the blade.

FIG. 8 shows a view from the bottom of the slicing apparatus, illustrating a means of utilizing the motion of the driveshaft [5] to power the motion of the blade [35]. This is done by connecting driveshaft pulley [45] which is mounted to the driveshaft [5] to a blade pulley & bearing assembly [47] which is mounted to the frame [1] and to which the blade [35] gets secured to. A timing belt [49] connects driveshaft pulley [45] and blade pulley & bearing assembly [47]. Therefore, the power supplied by the motor [3] can be transmitted to the blade [35], enabling the blade to rotate without the need for a second motor. With this configuration, the driveshaft [5] must be rotating in order for the blade [35] to function optimally as the two are linked by the timing belt [49], and the rotation of the blade [35] is dependent upon the rotation of the driveshaft [5]. Note that the driveshaft pulley [45] is notably larger than the blade pulley & bearing assembly [47], a design which enables the blade [35] to rotate at a faster rate than the driveshaft [5]. The blade pulley & bearing assembly [47] is comprised of a shaft with one threaded end for the pulley to thread onto and be secured by a nut and another flat end with threaded holes to secure the blade [35] to, and the shaft is encompassed by a housing with a ball-bearing surrounding the shaft so that it can rotate freely within the housing, the housing gets mounted to the frame [1]; therefore as the pulley component of the blade pulley & bearing assembly [47] rotates, the blade [35] is rotated as the two are connected. Another feature visible from this view is a height adjustment mechanism [34] which is a simple mechanical device such as a nut and a lead screw that can be used to adjust the height of the height adjustable platform [33]. The mechanism [34] is mounted to the frame guard [43] and also to the height adjustable platform [33]. As depicted, the mechanism [34] is the only thing supporting the height adjustable platform [33], as the height is altered so is the distance between the blade [35] and the height adjustable platform [33] modifying the thickness at which ingredients are to be sliced at.

Figure 9:
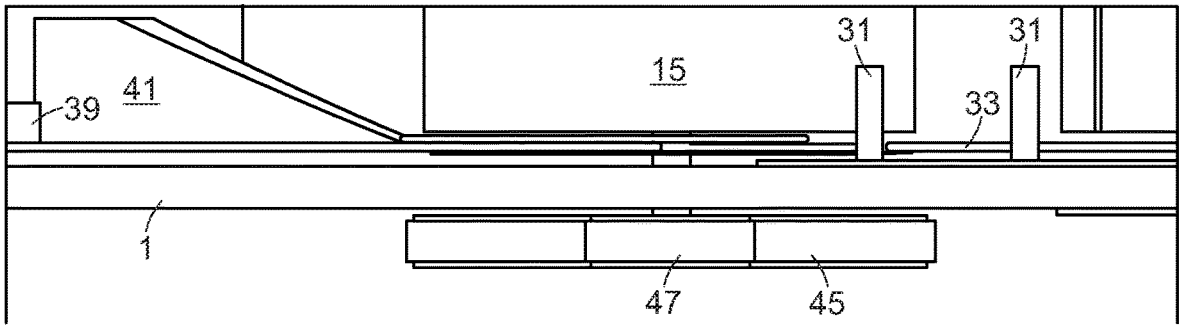
FIG. 9 is a side view of a portion of the slicing apparatus.

FIG. 9 shows a side view of the slicing apparatus which demonstrates that the blade pulley & bearing assembly [47] and the driveshaft pulley [45] are aligned at the same height so that the timing belt [49] operates smoothly. The timing belt [49] is intentionally invisible in this figure so that the assembly [47] is more clearly visible.

Figure 10:
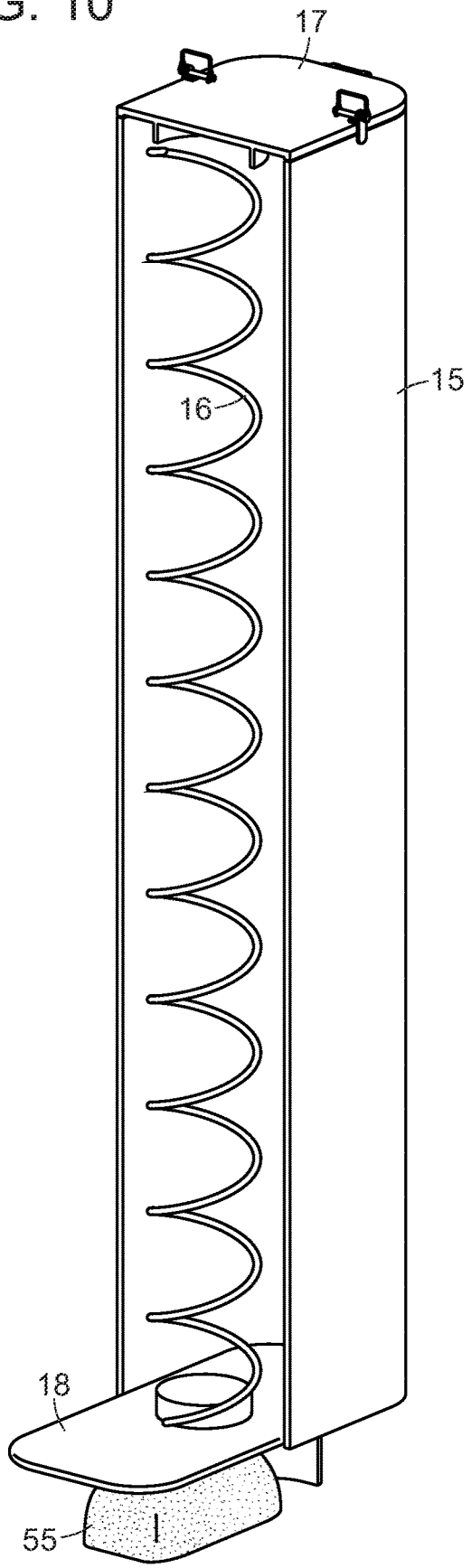
FIG. 10 is a modified view of an ingredient tube wherein a portion of the outer tube has been made transparent to demonstrate the internal components.

FIG. 10 is a view of the ingredient tube [15] which shows a portion of the ingredient tube [15] as being transparent so that the internal components of the ingredient tube [15] are visible; namely, the ingredient tube spring [16], and the ingredient tube buffer [18]. The ingredient tube lid [17] is secured by draw latches or a similar means, and provides the backstop for the ingredient tube spring [16], the other end of ingredient tube spring [16] makes contact with the buffer [18] which simply disperses the force from the ingredient tube spring [16] more evenly across the surface of the ingredient in the tube [55]. Note that in some instances no ingredient tube spring [16] is necessary and the simple weight of the ingredient [55] or an added weight can be used to propel the ingredient [55] downwards. Note that the far end of the ingredient tube extends downwards more than the near end, this is not an error but the ingredient tube [15] is designed like this so that the inner wall can make contact with the ingredient [55] even if the ingredient flap [20] is open as the inner wall of the ingredient tube [15] serves to guide and move the ingredient [55] so that it stays within the ingredient tube [15] as the chassis [7] is rotating and friction is present between the surface of the ingredient [55] and the height adjustable platform [33], the blade [35], blade cover [37], ramp [41] or etc.

What is not depicted in the drawing is the means of securing the ingredient tube [15] to the ingredient chamber frame [14] as it is not essential to understanding the invention and could be done in a multitude of ways; one way of securing the ingredient chamber [15] to the ingredient tube frame [14] is by means of adding two 90 degree brackets on opposite ends of the lid [17], one end protruding perpendicular to the top of the lid with a hole bored out of the center, the other end of the bracket welded or secure flat to the lid, a pin, nut and bolt or similar means could then pass through the center of the ingredient tube frame [14] and through the aforementioned bore hole in the bracket, securing the ingredient tube [15] to the ingredient tube frame [14].

Note that the ingredient tube [15] depicted is essentially a large rounded rectangle that is approximately 9"×4.5"×24" (length×width×height) and would be ideal for hosting a boiled ham or similar meat where the dimensions are slightly smaller than the ingredient tube [15]. However, the shape of the ingredient tube [15] can also be customized and optimized for each product, for example the ingredient tube for slicing tomatoes, could actually support two vertical stacks of cleaned and trimmed tomatoes by having the inner wall shaped similar to the number "8" by means of sheet metal bends and etc. this is perfectly feasible. Likewise, the ingredient tube for slicing American cheese which is generally a smaller square that would occupy about one half of ingredient tube [15] would be designed to hold two pieces of American cheese within the ingredient tube [15] by means of a divided wall, lip, or a custom shape, using two ingredient tube springs [16] and ingredient tube buffers if necessary.

A further example, in designing an ingredient tube for cutting smaller items such as cucumber or pickled cucumber with a diameter of approximately 2", eight stacks of cucumber could be housed within an ingredient tube [15] and when the ingredient tube [15] passes over the blade eight individual slices of pickles will be generated. This is preferable as it can generate eight slices of a smaller ingredient in one pass over the blade. The ingredient tube [15] size would be limited to the size of the ingredient chamber frame [14] which it must fit inside, and for instances where the one vertical stack of ingredients is notably smaller than the outer wall of the ingredient tube [15] the ideal configuration is to keep the outer edges of the ingredient tube [15] the same approximate size as the ingredient chamber frame [14] it must fit inside of, meanwhile having custom inner walls that can hold several stacks of smaller ingredients within a single ingredient tube [15], also enabling multiple slices to be cut by the blade [35] in a single pass of the ingredient tube[15] over the blade.

Figure 11:
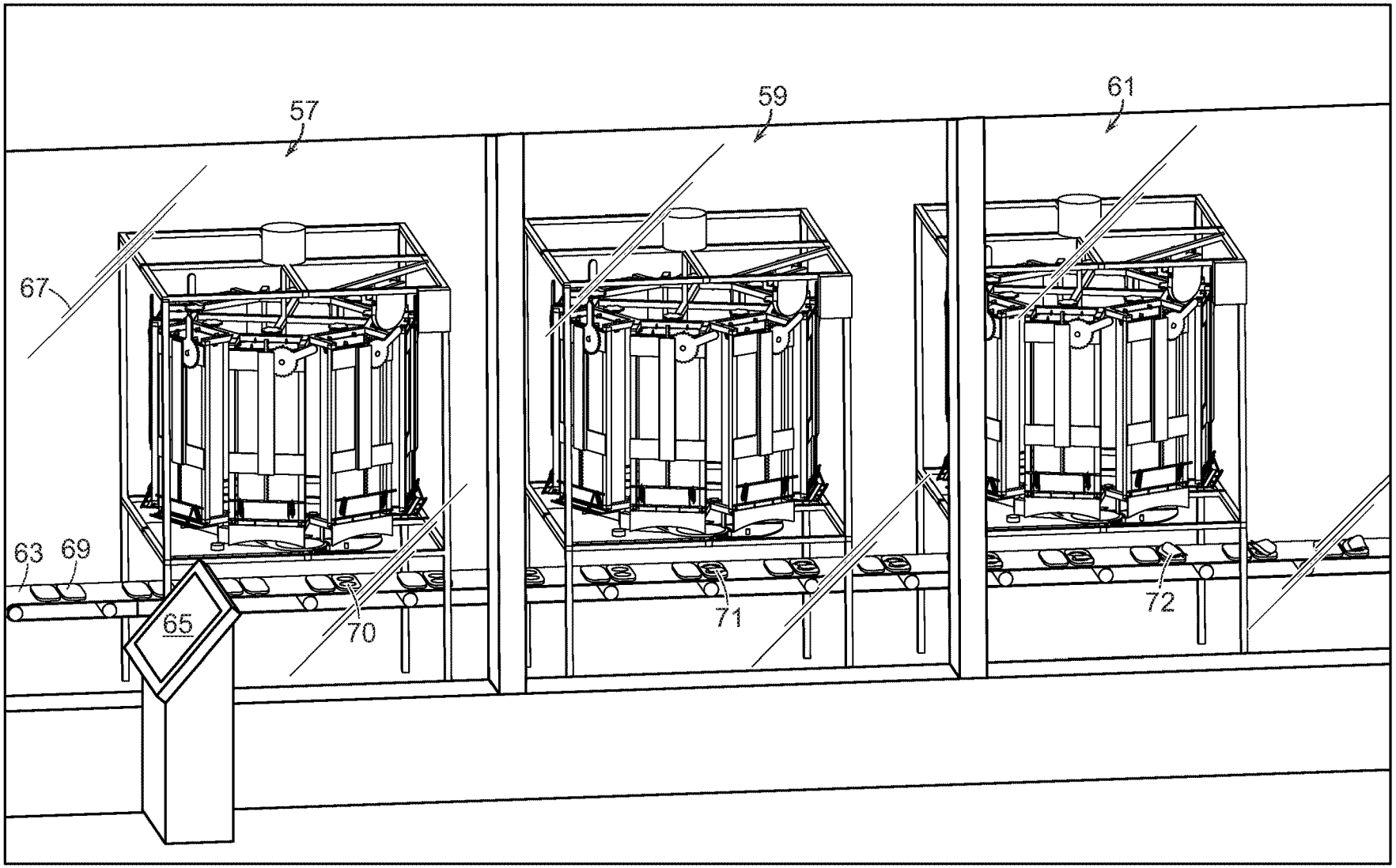
FIG. 11 is a perspective view of a sandwich assembly line utilizing three slicing apparatuses.

FIG. 11 depicts three slicing apparatuses being used over a conveyor belt [63] for the purpose of building sandwiches. From left to right, there is a slicing apparatus loaded with produce ingredients [57], a slicing apparatus loaded with meat ingredients [59] and a slicing apparatus loaded with cheese ingredients [61]. There is safety glass [67] separating the production area from the customer or employee area, and a computerized display kiosk [65] is shown.

The computerized display kiosk [65] is a place where a customer or employee could provide inputs such as which ingredients they desire on a particular sandwich, and the computerized display kiosk [65] would then command the slicing apparatuses to build a sandwich per the inputs it gathered. The conveyor [63] is a motorized conveyor which moves the bread from left to right, starting with plain bread with no ingredients deposited on it [69], as the plain bread [69] passes underneath slicing apparatus [57] and chosen produce ingredients would be deposited onto the bread for example lettuce and tomato, as a bread with produce ingredients deposited onto it [70] is seen further along the conveyor.

Next as the bread travels under the slicing apparatus loaded with meat [59] any chosen meats would be deposited onto it, as a bread with produce and meat deposited onto it [71] is seen further along the conveyor. Next, as the bread passes underneath the slicing apparatus loaded with cheese ingredients [61] cheese could be deposited onto the bread per the customer or operator's specification, as a bread with produce, meat and cheese deposited onto it [72] is seen further along the conveyor. For example, if someone ordered a turkey and American cheese sandwich with lettuce and tomato, the bread would start on the left side and travel underneath the slicing apparatuses, slicing apparatus 57 would deposit slices of lettuce and tomato onto the bread, slicing apparatus 59 would deposit slices of turkey onto the bread, and slicing apparatus [61] would deposit slices of American cheese onto the bread forming the complete sandwich.

Note that all of the ingredients could theoretically be contained within one slicing apparatus but the preferred embodiment is to use a series of slicing apparatuses as it prevents cross contamination of meat and vegetables and also enables a greater variety of options and realistically the slicing thickness for each ingredient subcategory will vary so the preferred embodiment is depicted as keeping the ingredient subcategories separated. For instance, tomatoes and shredded lettuce will generally be cut at a thickness of 3/16-1/4" whereas meats and cheeses will be sliced at approximately 1/16". The other advantage of using multiple slicing apparatuses is that the blades can be optimized for each ingredient as the meat and cheese blades have slight design variations that optimize their cutting performance. Also, the invention is shown as housing eight ingredient chambers per each slicing apparatus yet more or less are perfectly feasible and within the scope of the invention.

Figure 12:
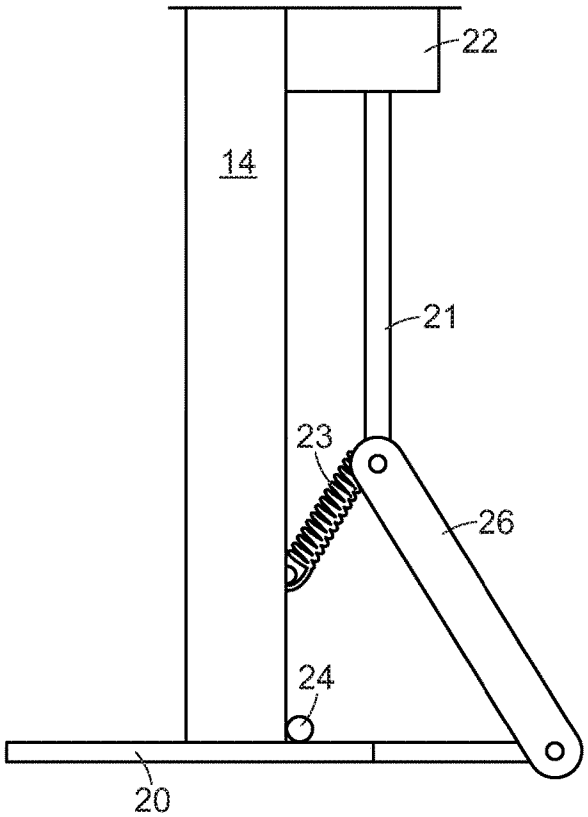
FIG. 12 is a side view of the ingredient chamber depicting the ingredient flap in the closed position.

FIG. 12 shows the side view of an ingredient chamber with the ingredient flap [20] in the closed position and demonstrates the position of the linkage [26] and how it interacts with the extension spring [23] and the ingredient flap [20]. The bottom of the extension spring [23] is secured to the ingredient chamber frame [14] and the top end of the spring [23] is secured to the gear rack [21] by means of the horizontal rod that is secured to the bottom of the gear rack [21], the force of the spring [23] exerts downward pressure on the linkage [26] causing it to push on the end of the flap [20], keeping the flap [20] closed.

Figure 13:
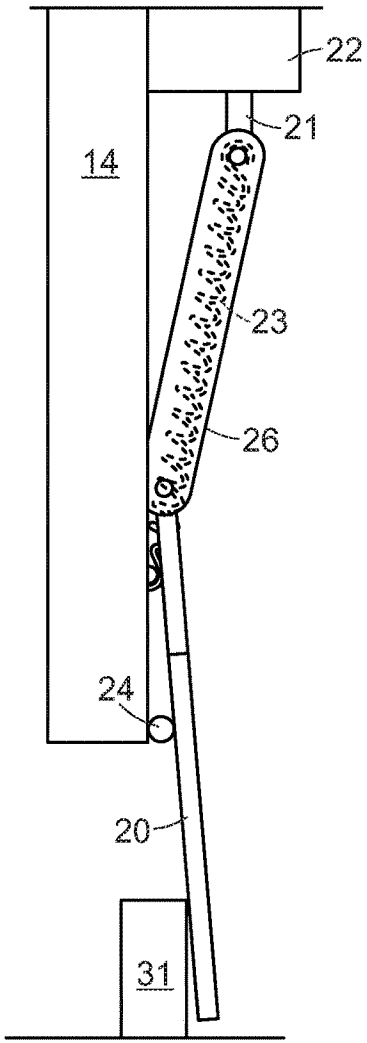
FIG. 13 is a side view of the ingredient chamber depicting the ingredient flap in the "locked open" position. wherein a mechanical spring powered action holds the ingredient flap open.

FIG. 13 demonstrates the action of the mechanism which can hold the ingredient flap [20] in the "locked open" position [19]. After the ingredient flap [20] has been opened by means of rotation of the gear lever [13], the inner edge of the ingredient flap [20] makes contact with the flap opening bumpers [31] which serve to push the ingredient flap [20] into the "locked open" position. Several means of keeping the ingredient flap [20] "locked open" are possible and within the scope of the present invention, the means which demonstrates the action most clearly is described in the following. Note that the bottom of the linkage [26] has been moved to the left side of the flap hinges [24], by means of the flap opening bumper [31] opening the ingredient flap [20] beyond 90 degrees of rotation, in this position now the force from the spring [23] is causing the linkage [26] to be pulled in the direction towards the frame of the ingredient chamber [14] in essence "locking" the ingredient flap [20] in the open position as the ingredient flap [20] cannot rotate open any further without making contact with the frame of the ingredient chamber [14] hence the spring [23] is essentially jamming the linkage [26] in place momentarily as the means of keeping the ingredient flap [20] held open until it makes contact with the ingredient closing bumper [39].

I claim:

1. A slicing apparatus comprising:

a rotatable chassis assembly including:

a chamber for holding a food ingredient, and a rotatable chassis which houses said chamber and moves the chamber in a revolving motion along an orbital path;

a motor operatively connected to the chassis assembly to rotate the chassis assembly;

a blade, used to slice said food ingredient, said blade being positioned adjacent to the orbital path of said chamber such that a portion of the food ingredient that extends from said chamber can be sliced by said blade as the chassis assembly is rotated;

a moveable obstructing device affixed to the chamber assembly in a manner that the obstructing device can obstruct the movement of said food ingredient within the chamber in one position and facilitate the movement of said food ingredient within the chamber in another position;

a moveable lever protruding from the chamber assembly, said lever being connected to the obstructing device in a manner that the movement of the lever changes the position of the obstructing device, thereby either obstructing or facilitating the movement of said food ingredient within the chamber; and a moveable bumper movably mounted independently of the chassis assembly, said bumper positioned in proximity to an orbital path of said lever and being capable of making contact with the lever in one position and avoiding contact with the lever in another position;

wherein the position of the bumper is changeable as the chassis assembly is rotated.

2. The slicing apparatus of claim 1 further comprising a ramp, positioned adjacent to the orbital path of said chamber so that a remaining portion of said food ingredient that extends from said chamber can come into contact with the ramp after said portion has been sliced by the blade as the chassis assembly is rotated, the ramp being used to elevate the remaining portion of said food ingredient back into the chamber after said portion of said food ingredient has been sliced.

3. The slicing apparatus of claim 1 further comprising:

said chassis assembly further including a plurality of additional said chambers housed by the rotatable chassis, each of the additional said chambers being equipped with a respective said moveable obstructing device and a respective said moveable lever; and an actuator mounted to the bumper and operable to change the position of the bumper.

* * * * *